US006393211B1

(12) United States Patent
Jolan et al.

(10) Patent No.: US 6,393,211 B1
(45) Date of Patent: May 21, 2002

(54) HEAT RADIATOR ASSEMBLY

(75) Inventors: Amir Jolan, Longueull; Sylvain Marchand, Delson, both of (CA)

(73) Assignee: Les Importations DMD Inc., Montreal (CA)

( * ) Notice: Subject to any disclaimer, the term of this patent is extended or adjusted under 35 U.S.C. 154(b) by 0 days.

(21) Appl. No.: 09/449,966

(22) Filed: Nov. 26, 1999

Related U.S. Application Data

(63) Continuation-in-part of application No. 08/843,137, filed on Apr. 28, 1997, now abandoned.

(51) Int. Cl.[7] ..... F12V 7/00
(52) U.S. Cl. ..... 392/423
(58) Field of Search ..... 392/423, 422, 392/424, 421, 420; 217/4.5, 411; 362/346, 297, 217, 260

(56) References Cited

U.S. PATENT DOCUMENTS

| | | | | |
|---|---|---|---|---|
| 3,953,100 A | * | 4/1976 | Feeney | 439/206 |
| 4,106,083 A | * | 8/1978 | Wolf | 362/217 |
| 4,315,302 A | * | 2/1982 | Petralia | 362/226 |
| 5,438,233 A | * | 8/1995 | Boland et al. | 313/110 |

* cited by examiner

*Primary Examiner*—Teresa Walberg
*Assistant Examiner*—Vinod D Patel
(74) *Attorney, Agent, or Firm*—Mila Shvartsman

(57) ABSTRACT

A heat radiator assembly having at least one heat radiator unit which comprises in combination a base and a primary reflector mounted on the base, the primary reflector having an elongated body with side walls (with a parabolic configuration in cross-section) upstanding outwardly from the base and end walls. A high power heating lamp is accommodated within the primary reflector by means of an elongated gap formed between lateral edges of the side walls of the primary reflector adjacent to the base. A secondary reflector having a generally elongated configuration is mounted on the base; it has an inner and an outer surface. The secondary reflector's inner surface faces the elongated gap of the primary reflector and the outer surface faces the base; the secondary reflector is adapted to reflect all lost radiation emitted from the lamp through the gap towards the base, thus facilitating prevention of overheating of the base and increasing efficiency of the heat radiator assembly. The secondary reflector has a concave configuration in cross-section, and the primary and secondary reflectors may be made of tempered gold-anodized aluminum embossed with a pattern facilitating heat radiation efficiency and to strengthen structural integrity of the heat radiator unit.

26 Claims, 25 Drawing Sheets

Rough aluminum

HEAT RADIATOR ASSEMBLY

This application is a continuation-in-part of the earlier filed application Ser. No. 08/843,137 filed Apr. 28, 1997, abandoned.

BACKGROUND OF THE INVENTION

This invention generally relates to heat transfer by radiation. More specifically, the present invention relates to a combination of infrared (IR) lamps and reflectors uniquely designed and arranged to realize maximum heat radiation from IR lamps to objects in front with maximum efficiency in terms of energy consumption.

There is known U.S. Pat. No. 5,003,449 related to a light fixture with secondary reflector comprising a secondary reflector located between the primary reflector and the bulb and provided for dispersion of concentrated heat produced by the bulb to maintain the primary reflector at a lower temperature.

There is also known U.S. Pat. No. 4,315,302 related to a quartz light fixture having a closed fixture reflector assembly consisting a lens mounted in front of an outer portion and an inner portion. Reflectors are made from a white aluminum to facilitate intensification of light from a lamp. However, this assembly is provided strictly for lighting purposes only and cannot be used for heating.

SUMMARY OF THE INVENTION

A variety of heat radiator units have been available for years, and some have been used in various industrial applications. Traditional room heating systems mostly depend upon convection and conduction for heat conveyance. In the case of convection, heat is transferred to the occupants by bringing the air temperature to the required temperature.

The disadvantages of this method become particularly manifest when the room is occupied for a short period of time, or air changes are frequent. Also, a lot of energy is lost in heating up large volume of air, which takes considerable time. Moreover, when open-flame heating systems are involved, this system takes oxygen from the air and produces water vapour and other combustion products.

In many respects, heating by shortwave infrared radiation differs from other heating systems. This has to do with the high temperature of the radiant source, the directness of energy transfer, and eliminating the need for heating up the surrounding air or unnecessary parts of the room, such as the walls. Short wave infrared obeys the same laws of propagation as does visible radiation, and because of the compactness of the lamp, it can be accurately directed toward the objects to be heated, although it does require a direct line of sight between the source and the objects.

There are situations in which extra radiation is needed to create a thermally comfortable environment. One might think of churches, terraces, stadiums, etc., where no permanent heat is needed, but heat can be provided when it is required.

This heat can take one form of infrared radiation, generated by the short-wave IR lamps. This radiation is almost identical to solar radiation, but this system does not produce ultraviolet radiation (UV). The moment such a heater is turned on, the radiation is produced immediately and there is no heat when the radiator is turned off, thus facilitating so called instant zone heating.

The extra heat that is received by the people is called irradiance and is expressed in watts per squared meters ($W/m^2$). The solar radiation reaching a horizontal plane at sea level on a bright day is about 800 to 900 $W/m^2$.

The amount of extra heat that is needed depends on:

The ambient air temperature

The clothing people are wearing

The activity of the people

The air velocity.

The present invention allows to solve existing problems comprises heat radiator unit including a base, a primary reflector mounted on the base. Primary reflector having an elongated body comprising side walls upstanding outwardly from the base and end walls Primary reflector is adapted to accommodate a high power heating lamp, wherein said lamp is accommodated within said primary reflector by means of an elongated gap formed between lateral edges of the side walls of said primary reflector adjacent to the base. A secondary reflector mounted on the base. Secondary reflector having generally an elongated configuration, and including an inner surface and an outer surface, the secondary reflector's inner surface is facing the elongated gap of the primary reflector and said the surface is facing said base. The advantage of such arrangement allows the secondary reflector is adapted to reflect all lost radiation emitted from said lamp through said gap towards the base, thus facilitating prevention of overheating of the base and increasing efficiency of the heat radiator assembly. Primary and secondary reflectors are formed from a material adapted to withstand the high power heat generated by the lamp and to emit an eye-friendly worn colour. The assembly of the present invention is housed in an open enclosure or housing adapted to withstand thermal expansion and to ventilate and evacuate the high power heat generated by the lamp.

The heat radiator assembly of the present invention is more efficient and more economical to operate than the prior art stacked heat radiator. It comprises an IRA HeLeNe lamp (made by PHILIPS) and an aluminum lamp holder which is designed to hold the lamps. The symmetric or asymmetric reflector from tempered aluminum provides a constant and very high reflectance of approximately 98%.

In one specific embodiment of this invention, each reflector is embossed with a unique pattern designed to promote the heat irradiance efficiency of the radiator and ensure structural integrity of the unit.

BRIEF DESCRIPTION OF THE DRAWINGS

The foregoing and other features of this invention will now be explained in more detail in the ensuing description of the preferred embodiment of the invention taken in conjunction with accompanying drawings.

DESCRIPTION OF THE PREFERRED EMBODIMENT OF THE INVENTION

Figure 1:
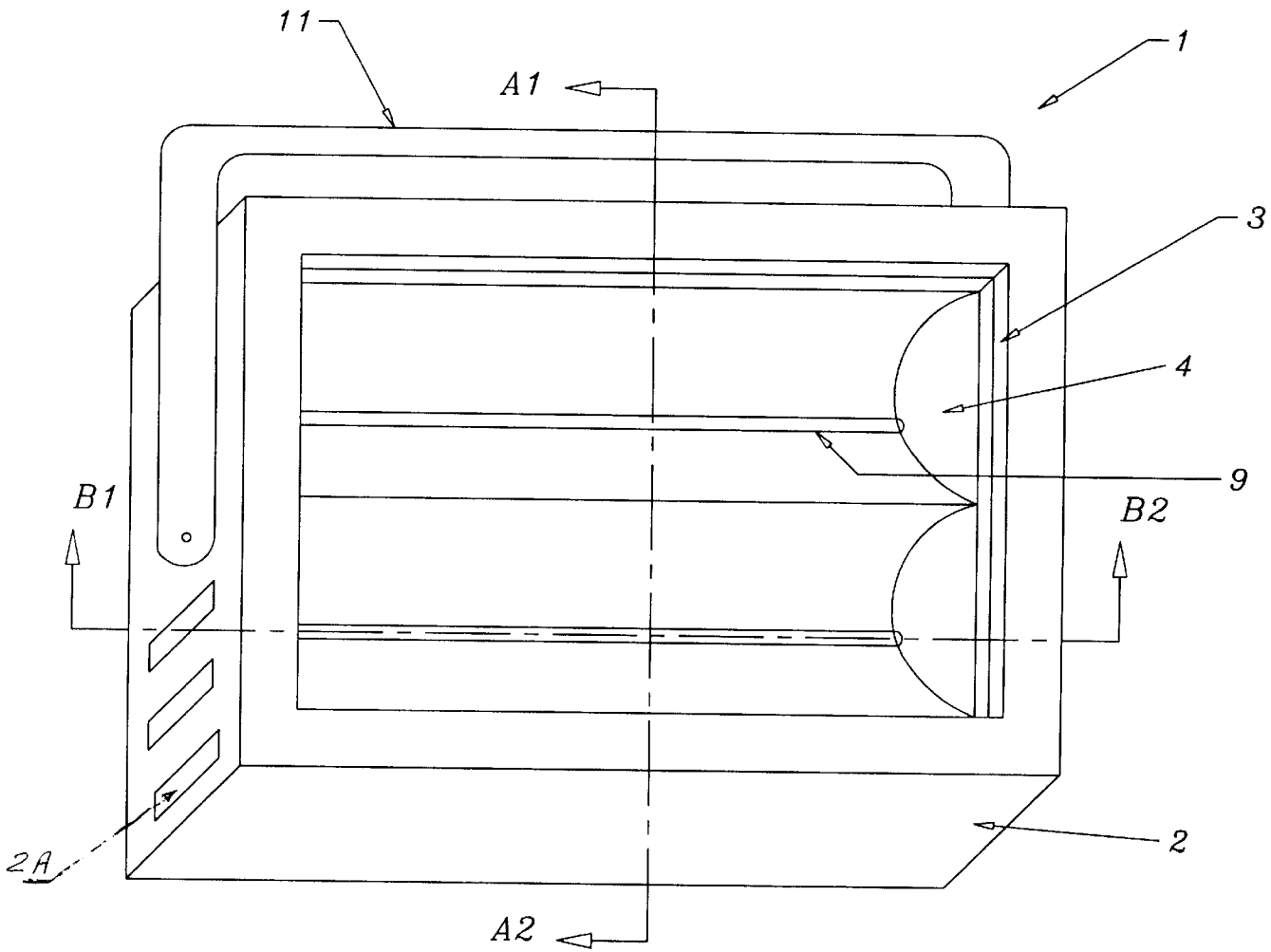
FIG. 1 is a perspective view of the heat exchanger constructed in accordance with this invention.
Figure 2:
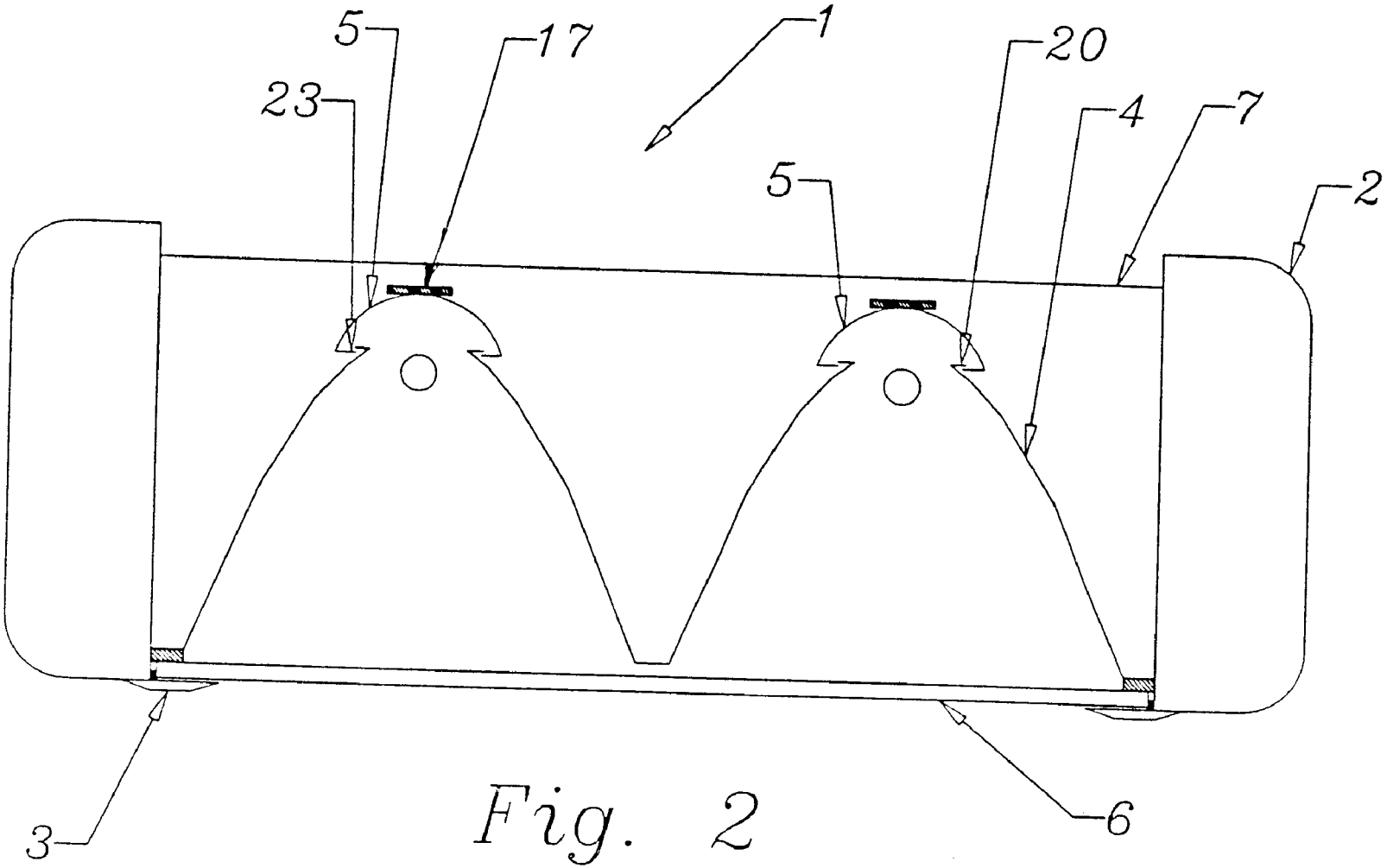
FIG. 2 is a cross-sectional view taken along the line A1–A2 of the FIG. 1.

Referring now to the drawings wherein like reference numerals designate like parts, FIG. 1 and FIG. 2 show a heat radiator assembly generally designated by the numeral, 1, comprising a metallic box 2 provided with ventilating openings 2A formed on side walls of box 2 and at the front provided with a frame 3 mounted on the box 2 in order to hold the complete reflector assembly. Ceramic glass or grill 6 is mounted in front of primary reflectors 4 to protect the assembly against any damage. The back panel or base 7 is provided to hold the wiring (not shown), the primary reflectors 4, and a lamp 8 in place (see FIG. 2). A bracket 11 is attached to the box 2 to hold the assembled unit and fix it on the wall. As the matter of construction and economy of the operation of the IR heater, this invention illustrates an assembly provided with two reflector units. However, the present invention is not restricted to such an arrangement, and depending on the heat needed in the specific zone, the assembly with one, two or three units provided with lamps of different power can be used.

Figure 3:
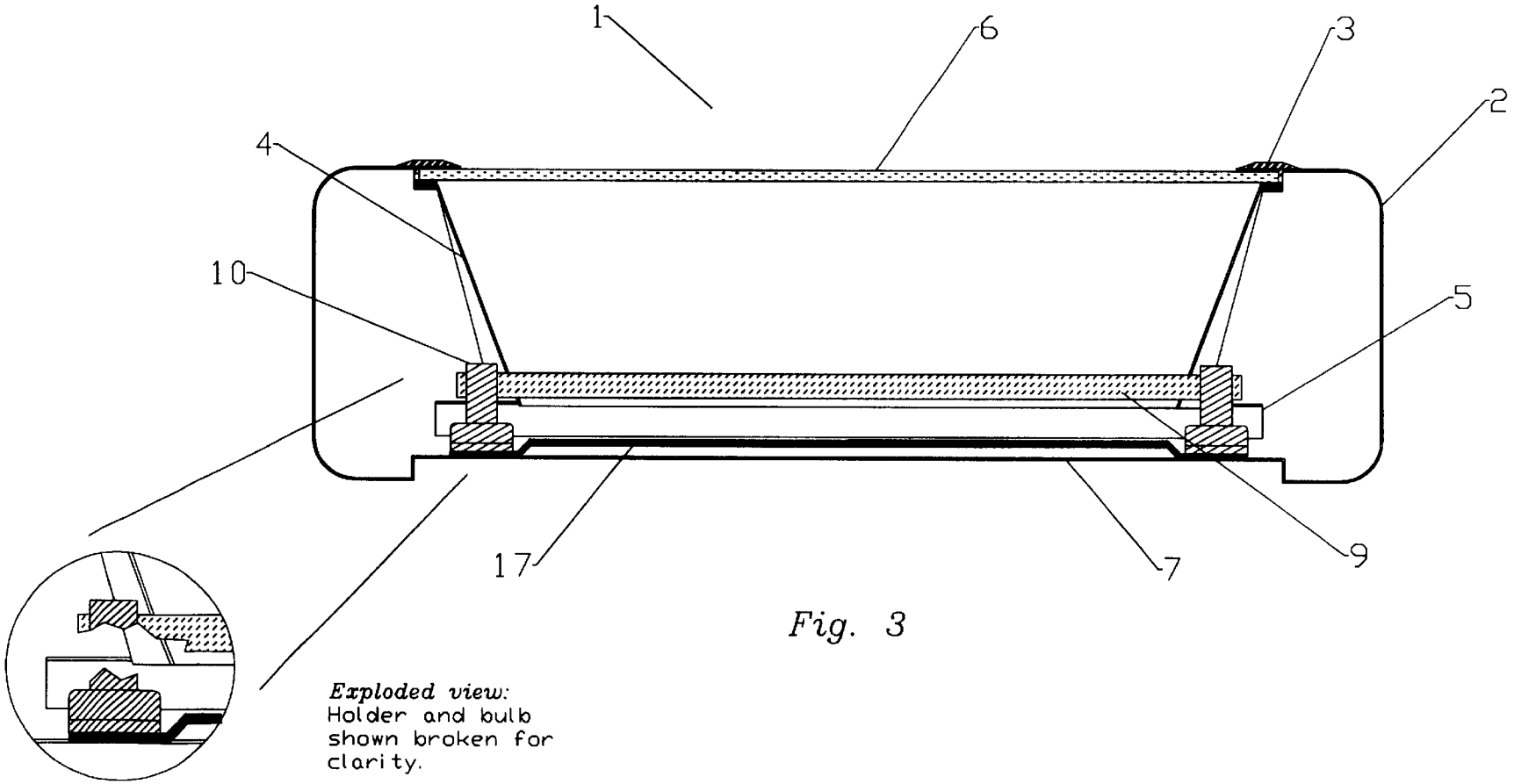
FIG. 3 is a cross-sectional view taken along the line B1–B2 of the FIG. 1.
Figure 5:
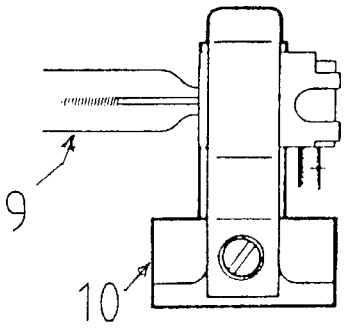
FIG. 5 is an end elevation view of the lampholder of FIG. 4.
Figure 6:
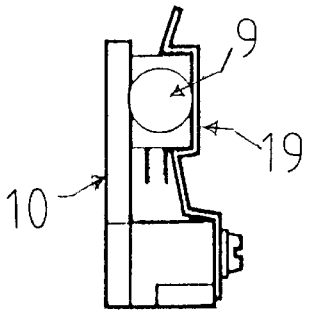
FIG. 6 is a side elevation view of the lampholder of FIG. 4.
Figure 4:
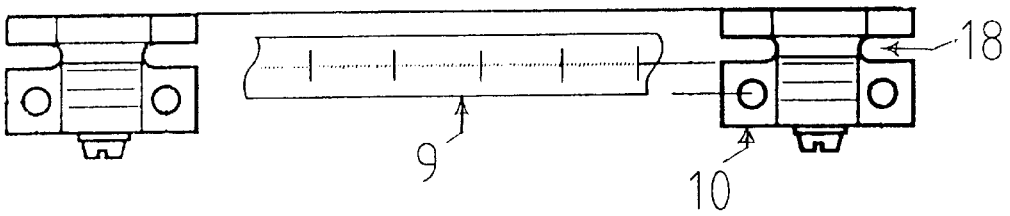
FIG. 4 is a top view of the lampholder with a metal straight edge.
Figure 7:
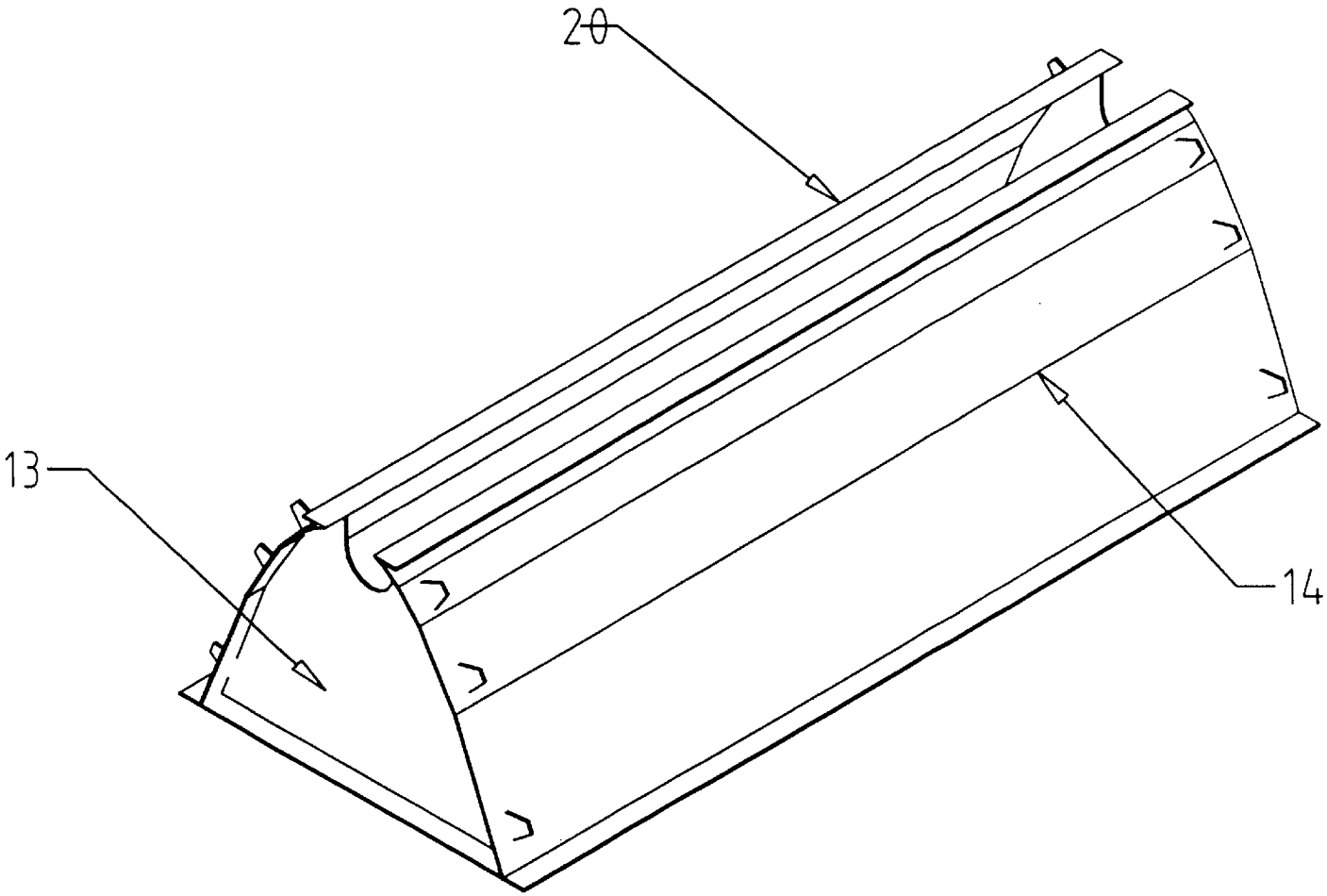
FIG. 7 is a perspective view of symmetric reflector.
Figure 8:
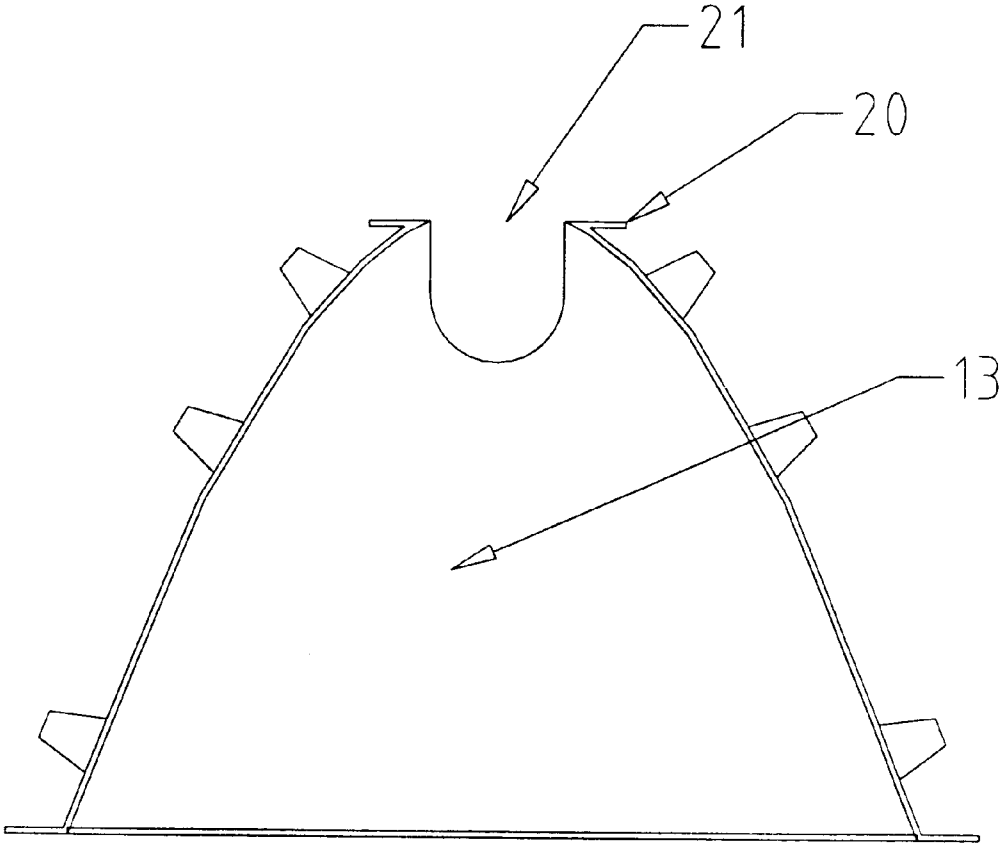
FIG. 8 is an end view of symmetrical reflector of FIG. 7.
Figure 9:
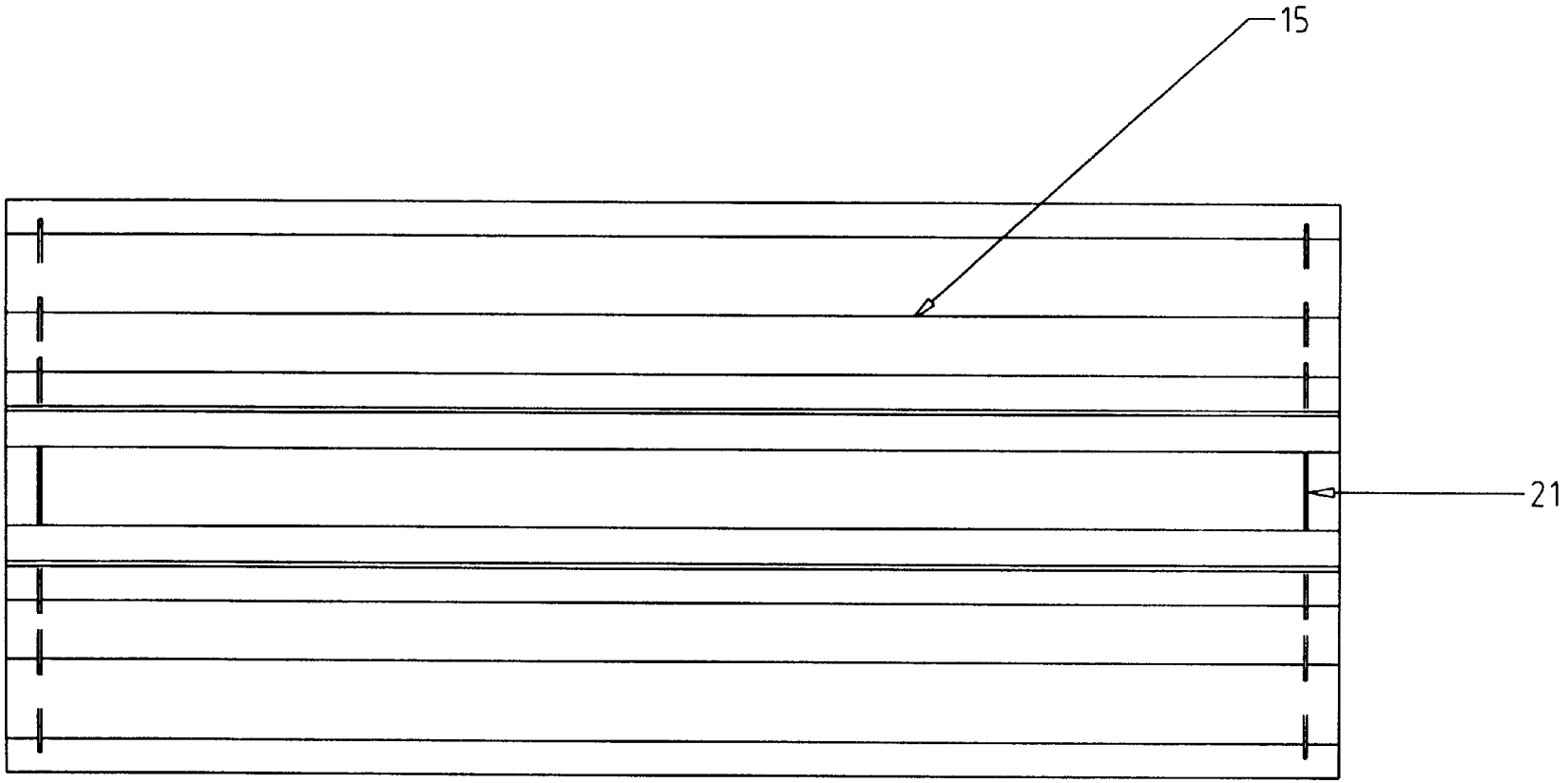
FIG. 9 is a bottom view of symmetric reflector of FIG. 7.
Figure 10:
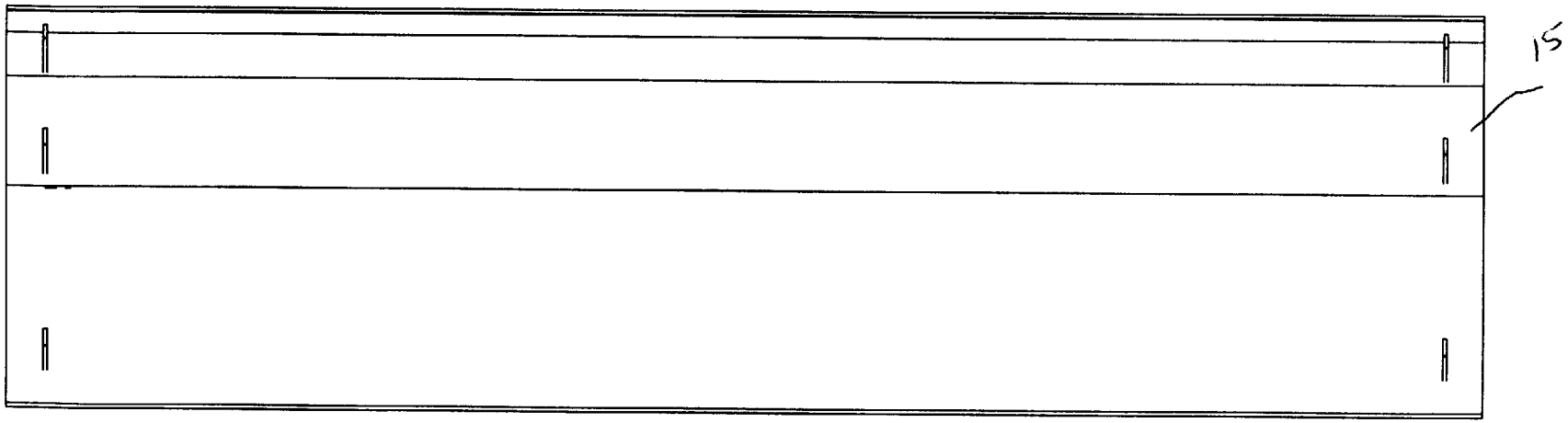
FIG. 10 is a side view of the symmetric reflector of FIG. 7 (2× per assembly).
Figure 11:
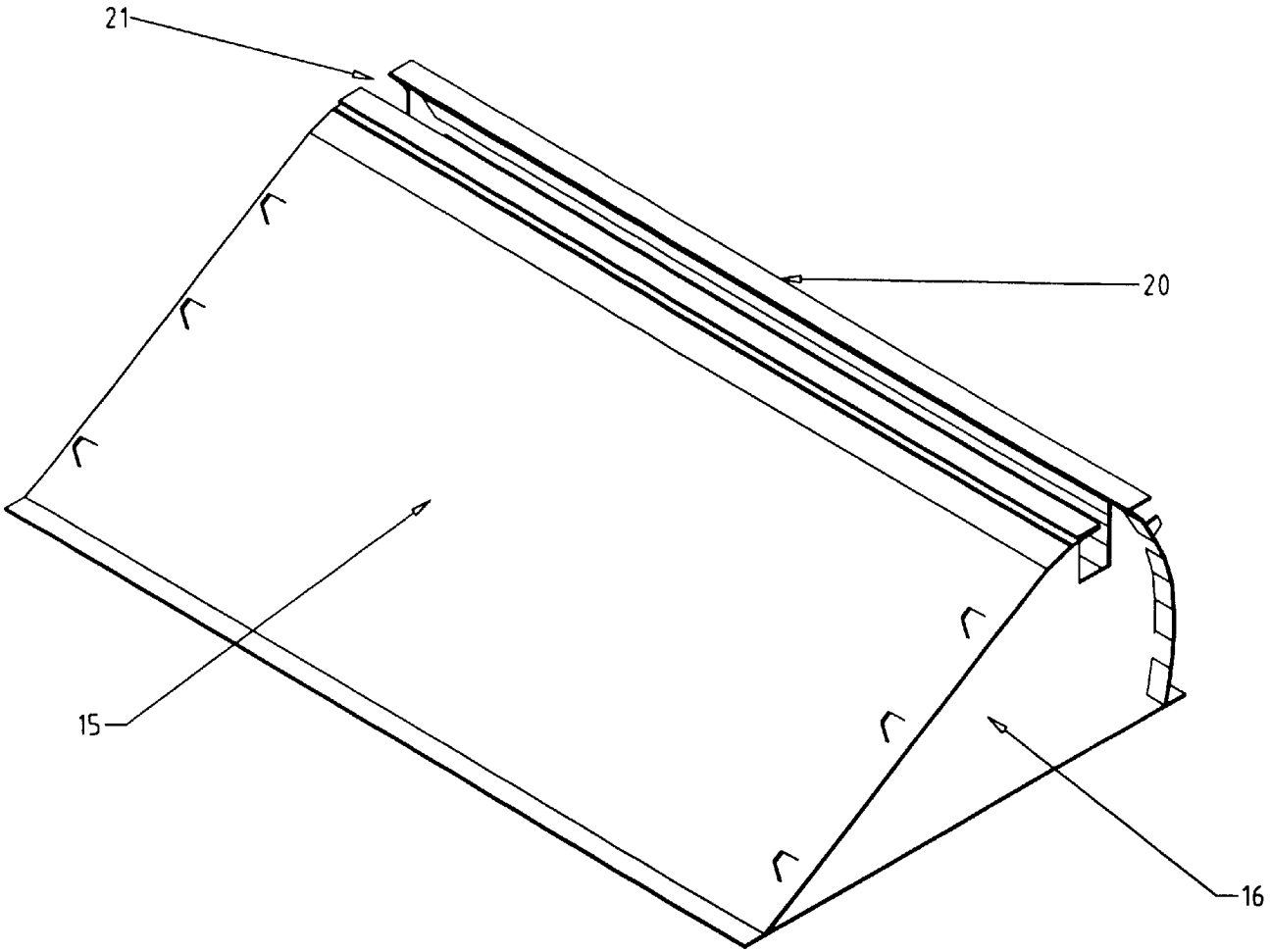
FIG. 11 is a perspective view of the asymmetric reflector.
Figure 12:
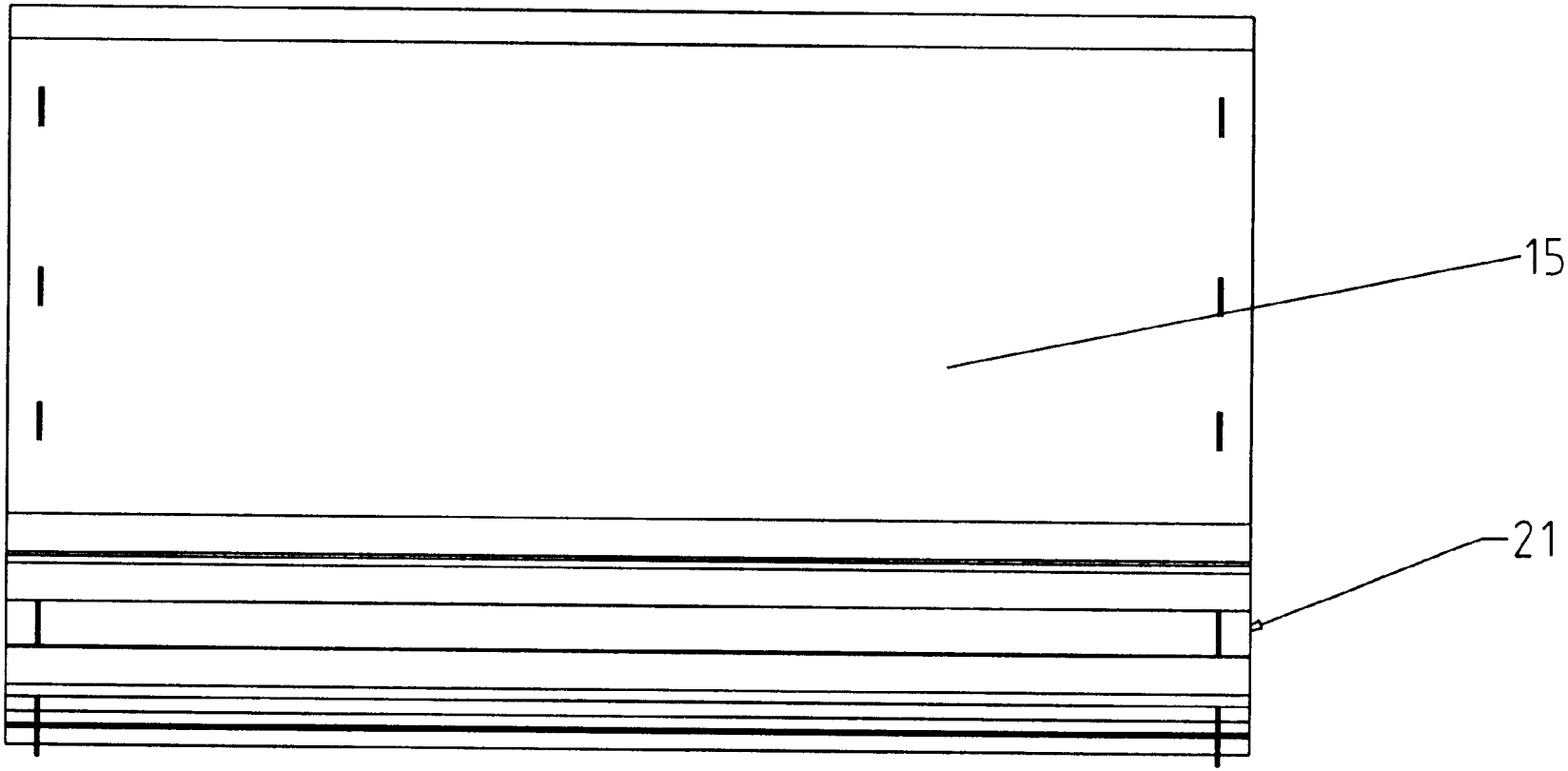
FIG. 12 is a bottom view of asymmetric reflector of FIG. 11.
Figure 13:
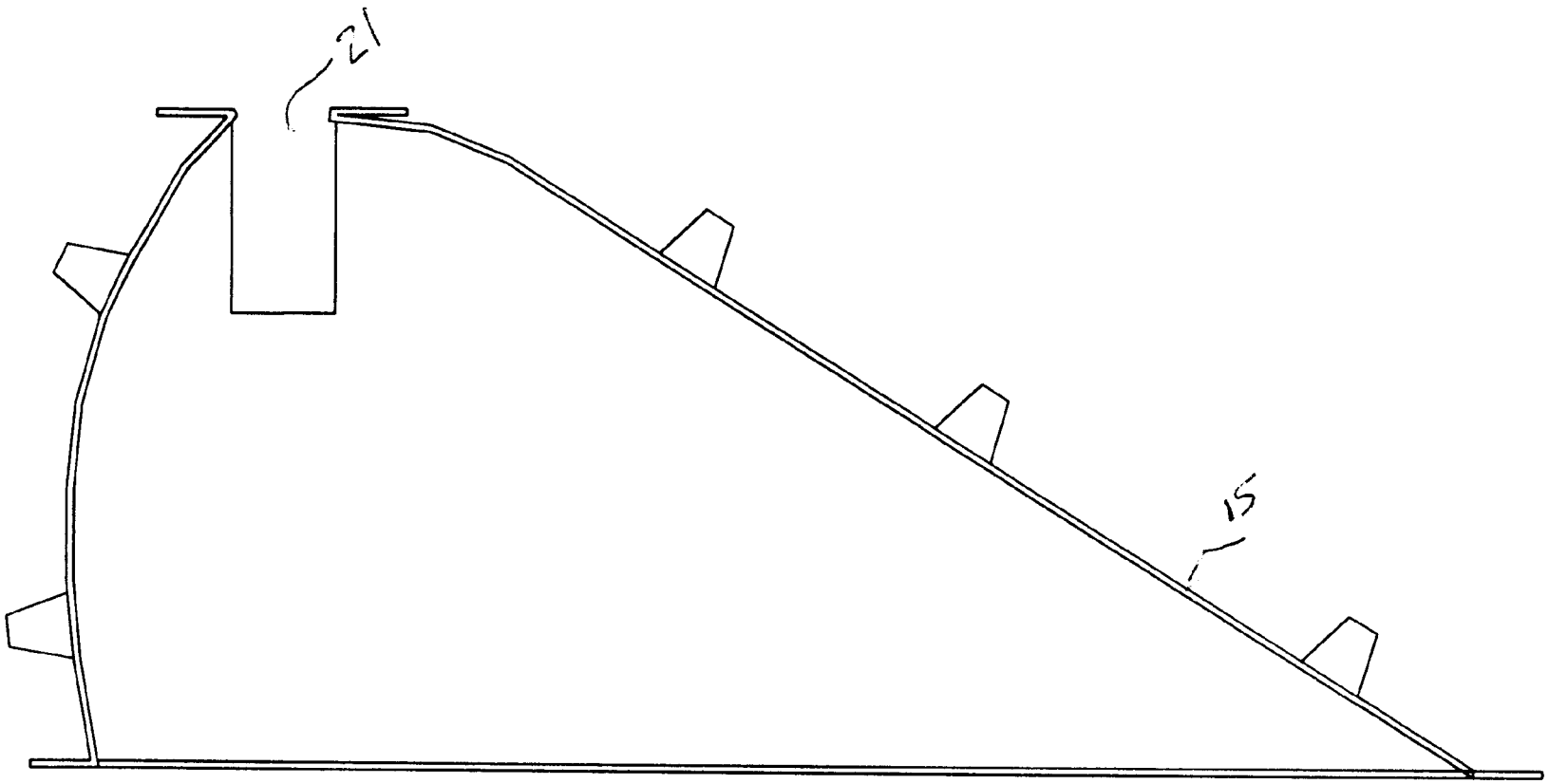
FIG. 13 is a side view of asymmetric reflector of FIG. 11 (2× per assembly).
Figure 14:
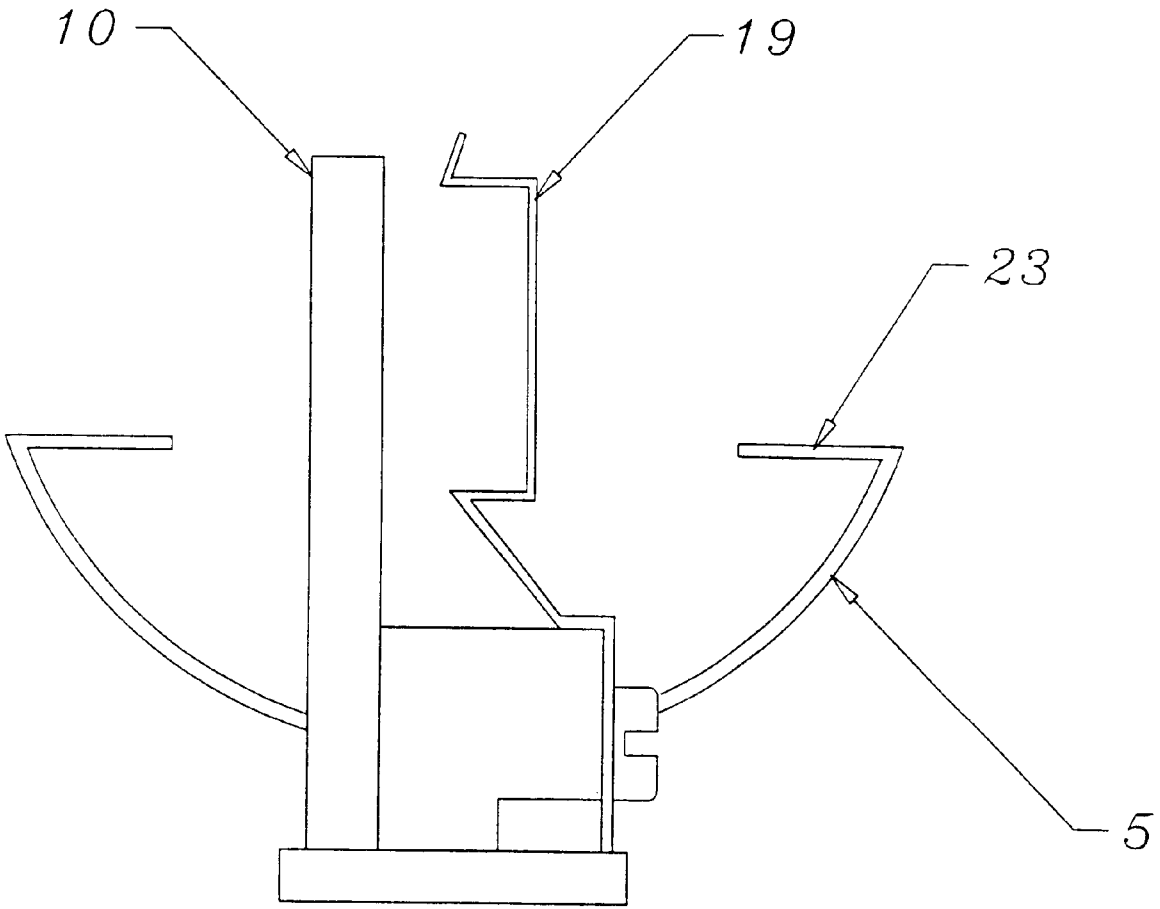
FIG. 14 is side view of a secondary reflector with lampholder.
Figure 15:
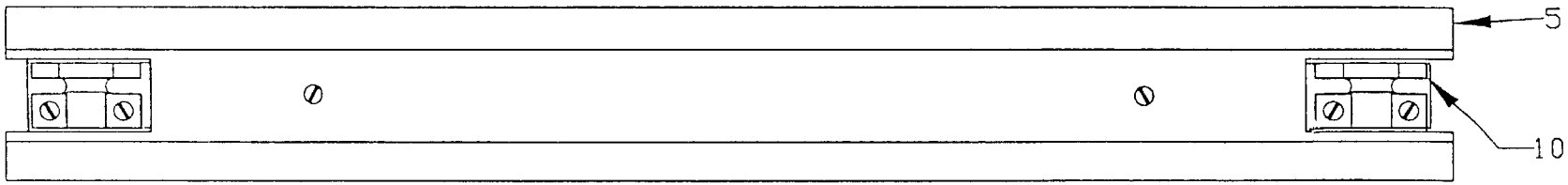
FIG. 15 is a plan view of secondary reflector and lampholder.

Two lampholders 10 are mounted on the back panel 7 of box 2 and are provided to support IR lamp 9 by means of springs 19. A slot 18 provided to accommodate electrical cables is formed on the lampholder 10. To ensure that the lampholders 10 are precisely in line with each other, a metal straight edge 17 (see FIG. 3) is used. The present invention illustrates two different types of primary reflectors, such as a symmetric parabolic reflector shown on FIGS. 7–10 and an asymmetric parabolic reflector shown on FIGS. 11–13. Each of the symmetrical reflectors comprises two side walls 13 and two end walls 14. Each asymmetrical reflector comprises two side walls 15 and two end walls 16. In the first embodiment of the present invention, those side walls and end walls are separate elements connected together. Lateral edges of side walls 13 and 15 form an elongated gap 21 between each other. Said elongated gap 21 is provided to accommodate the lamp 9 placed within the primary reflector 4.

Figure 17:
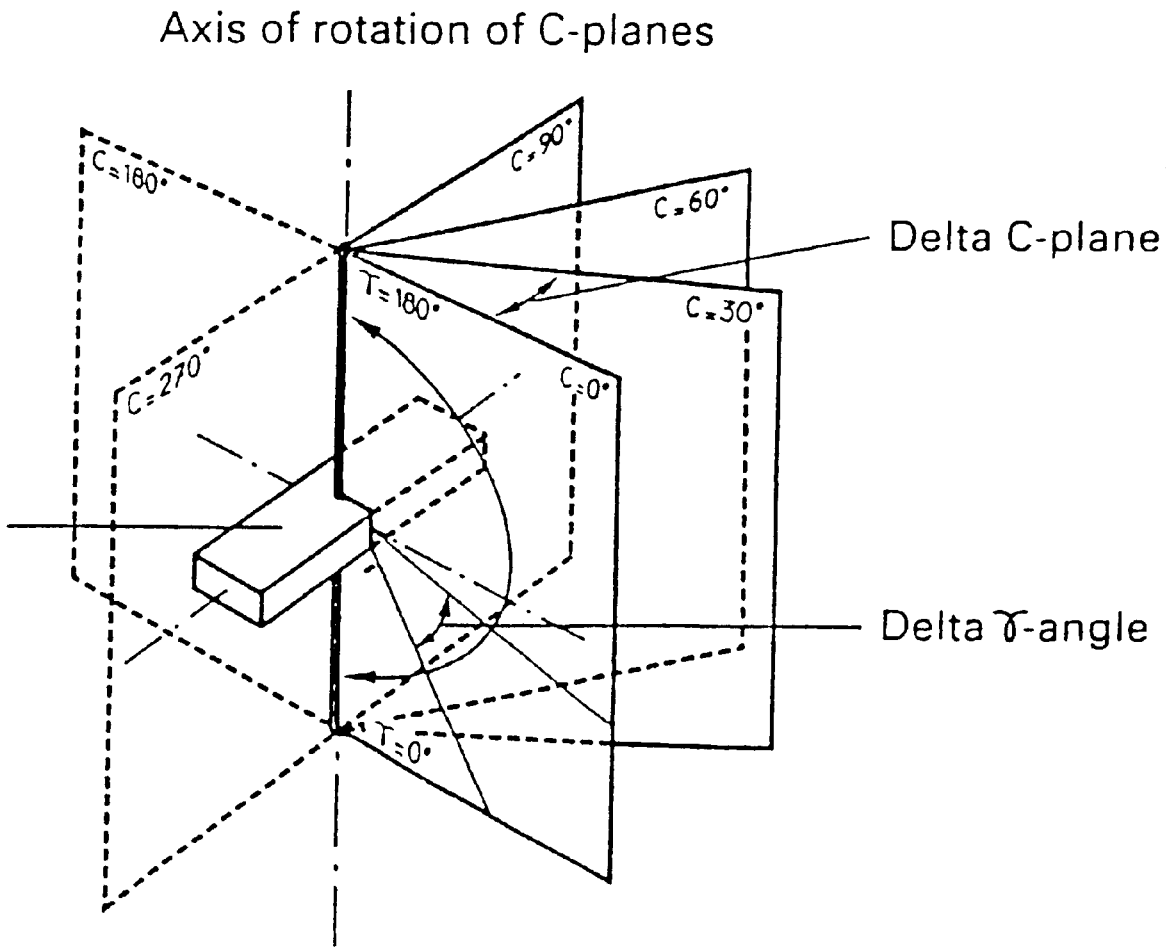
FIG. 17 shows the axis of rotation of C-planes of the heat radiator.

As shown on FIG. 17, the distribution of radiant intensity watts per stradiant (W/Sr) has been measured by a photogoniometer, that gives the output of the heat radiator in various planes (C=0, 30, 60, 90, etc.) at various gamma angles ($\gamma$). The parabolic symmetric type of primary reflector gives a narrow beam with its maximum directly underneath the heater ($\gamma$=0). The asymmetric type peaks at ($\bar{a}$=45') C=90°.

The asymmetric type of reflector is preferably used to be mounted against a wall without aiming of the beam being necessary. In case of substantial distances between the heat reflector and work plan, the symmetric type of the reflector is preferable.

Figure 16:
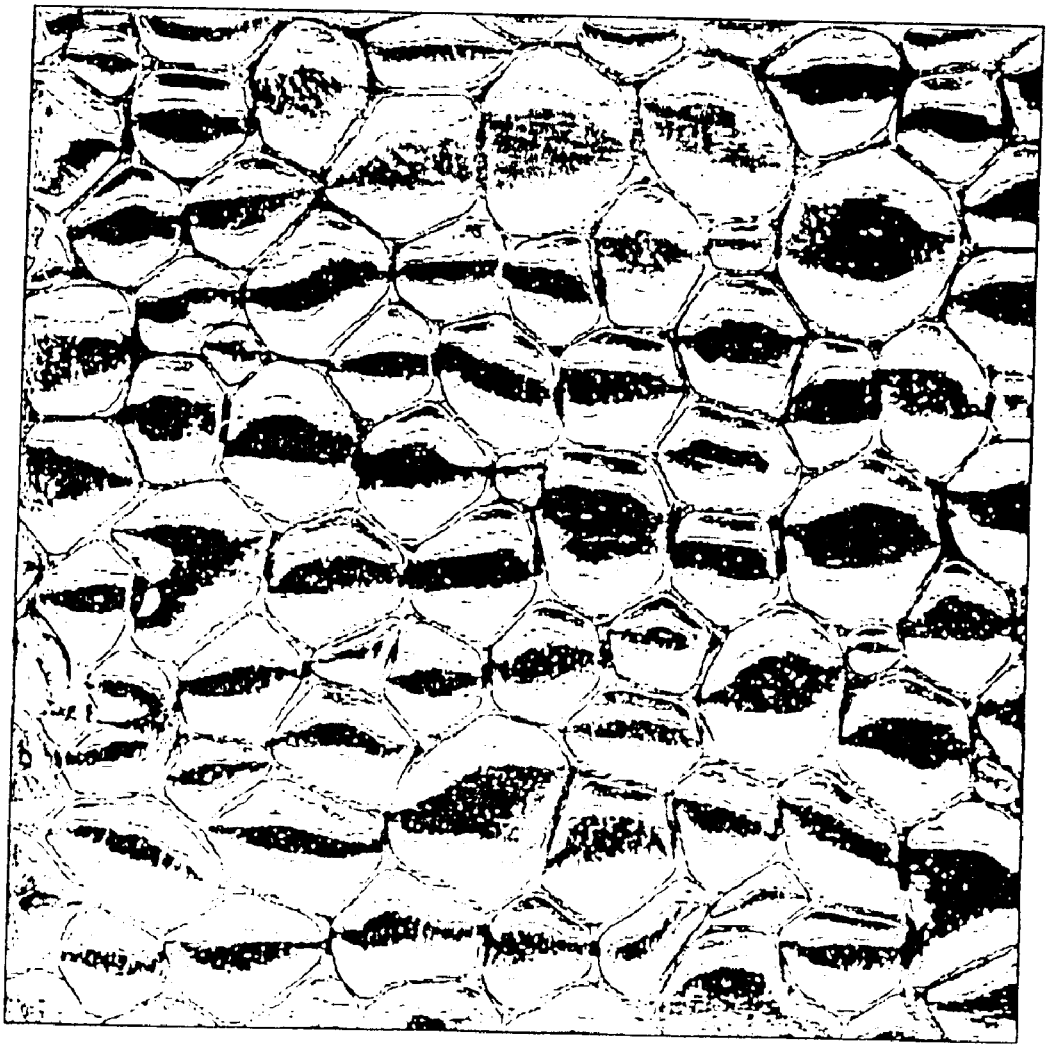
FIG. 16 is a fragment of aluminum plate used in making the reflector.

These reflectors can be made of smooth aluminum or rough (orange-peel structure) type gold anodized aluminum shown on FIG. 16. In case when the side walls of the primary reflector are faceted, an orange-peel type of aluminum facilitates a more uniform distribution of radiance than a smooth type. Reflectors 4 and 5 of all embodiments of the present invention are formed from a gold anodized aluminum and are capable to withstand corrosion from high power heat emitted by IR lamp 9 and to give a yellow eye-friendly gold colour.

As shown on FIG. 2, a secondary reflector 5 is placed between the primary reflector 4 and the back panel 7. This secondary reflector 5 comprises an elongated body having, in cross-section, a concave configuration. An inner surface of said secondary reflector is facing the gap 21 of the primary reflector 4, and an outer surface is facing the back panel 7. Secondary reflector 5 is provided with 4 inwardly inverted flanges 23 formed along lateral edges which are connectably engaged into the corresponding outwardly inverted flanges 20 formed along lateral edges of side walls 13 or 15 of the primary reflector 4. Such arrangement of flanges 20 and 23 (see FIG. 2) allows to connect the primary reflector 4 to the secondary reflector 5, which is in turn connected to the back plate 7.

Figure 18:
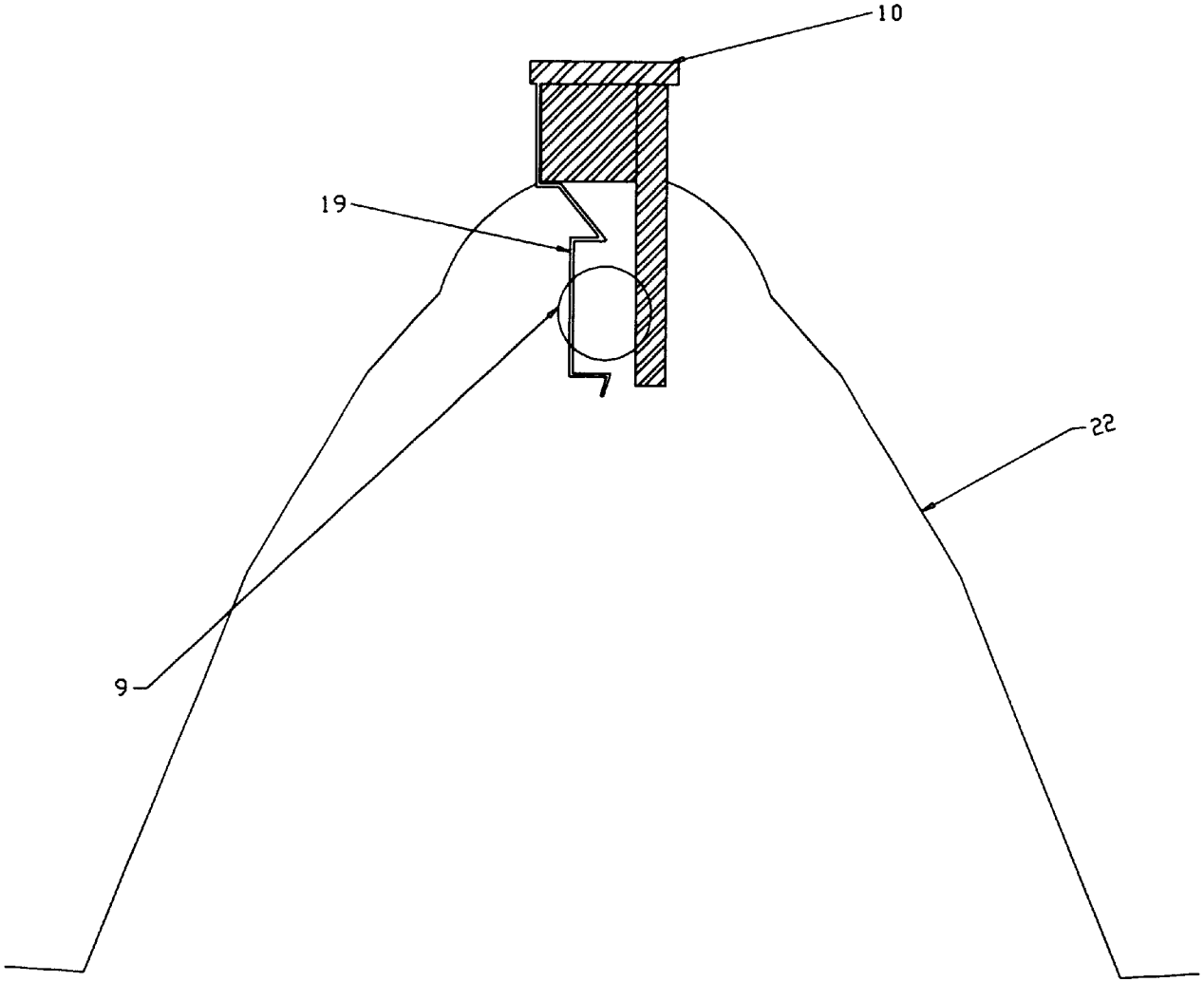
FIG. 18 is a cross-sectional view of the second modification of the present invention.
Figure 19:
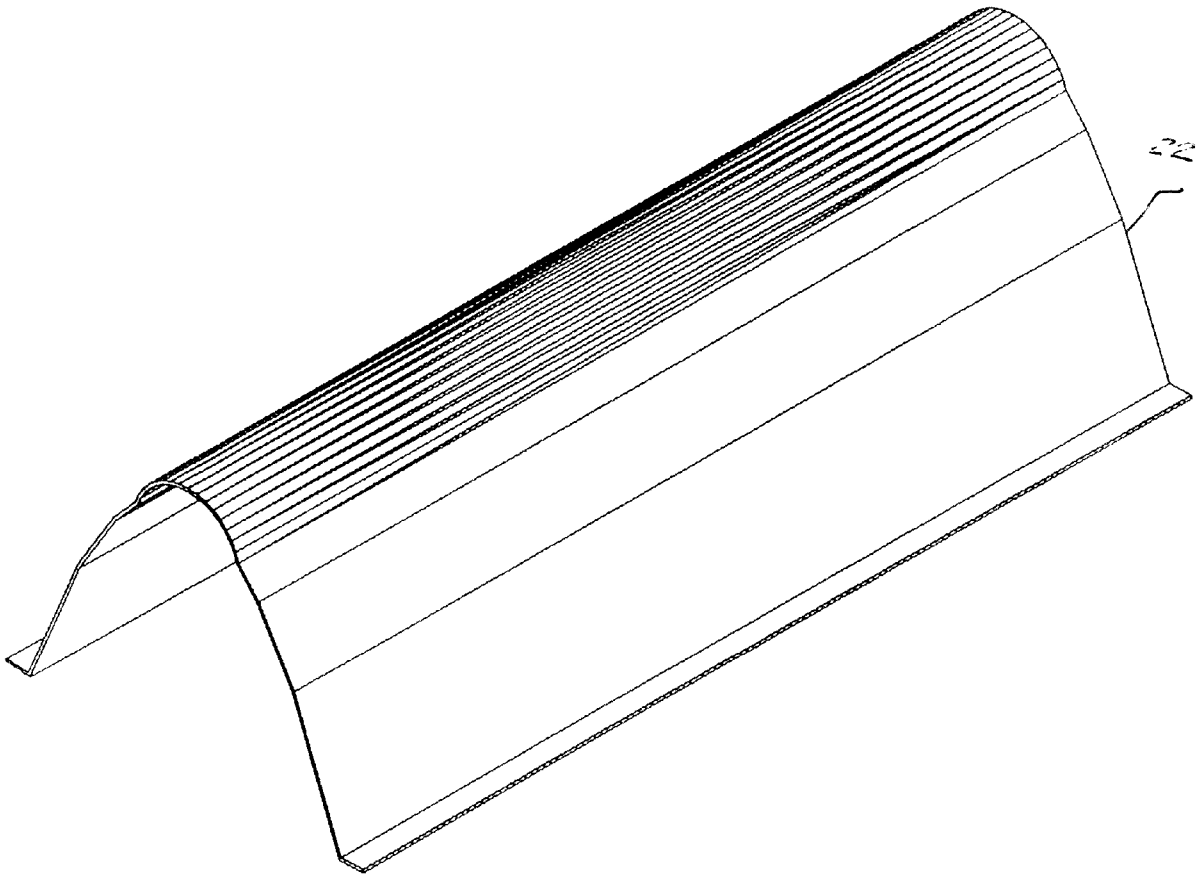
FIG. 19 is a perspective view of one-piece reflector of FIG. 18.

FIG. 18 shows a second modification of the present invention in which the primary and secondary reflectors form a one-piece unitary element 22. As in a first modification, side walls of the primary reflector are provided with a longitudinally oriented recess in the area adjacent to the base 7 to accommodate the lamp 9.

Figure 20:
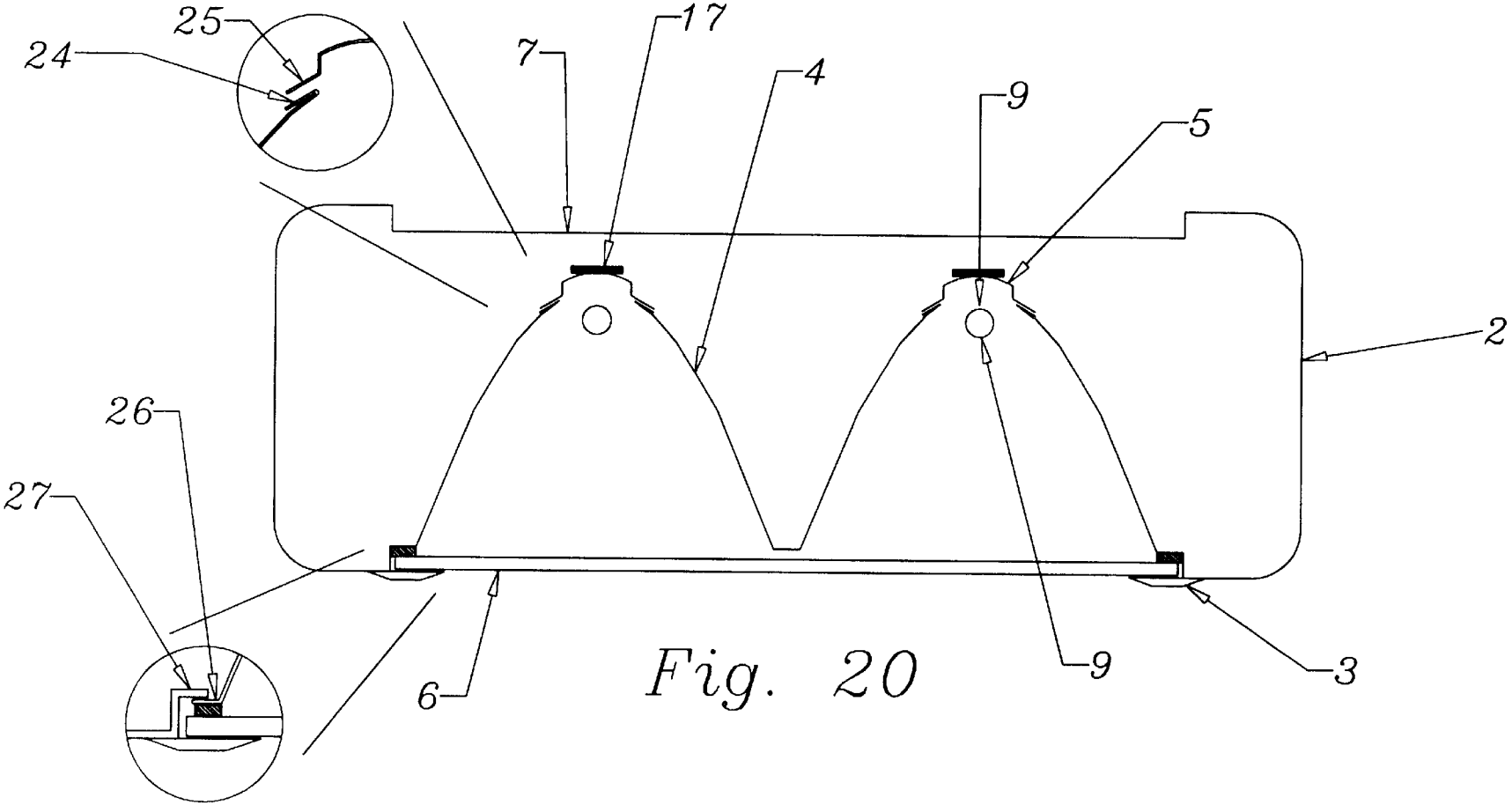
FIG. 20 is a cross-sectional view of the third embodiment of the present invention.
Figure 21:
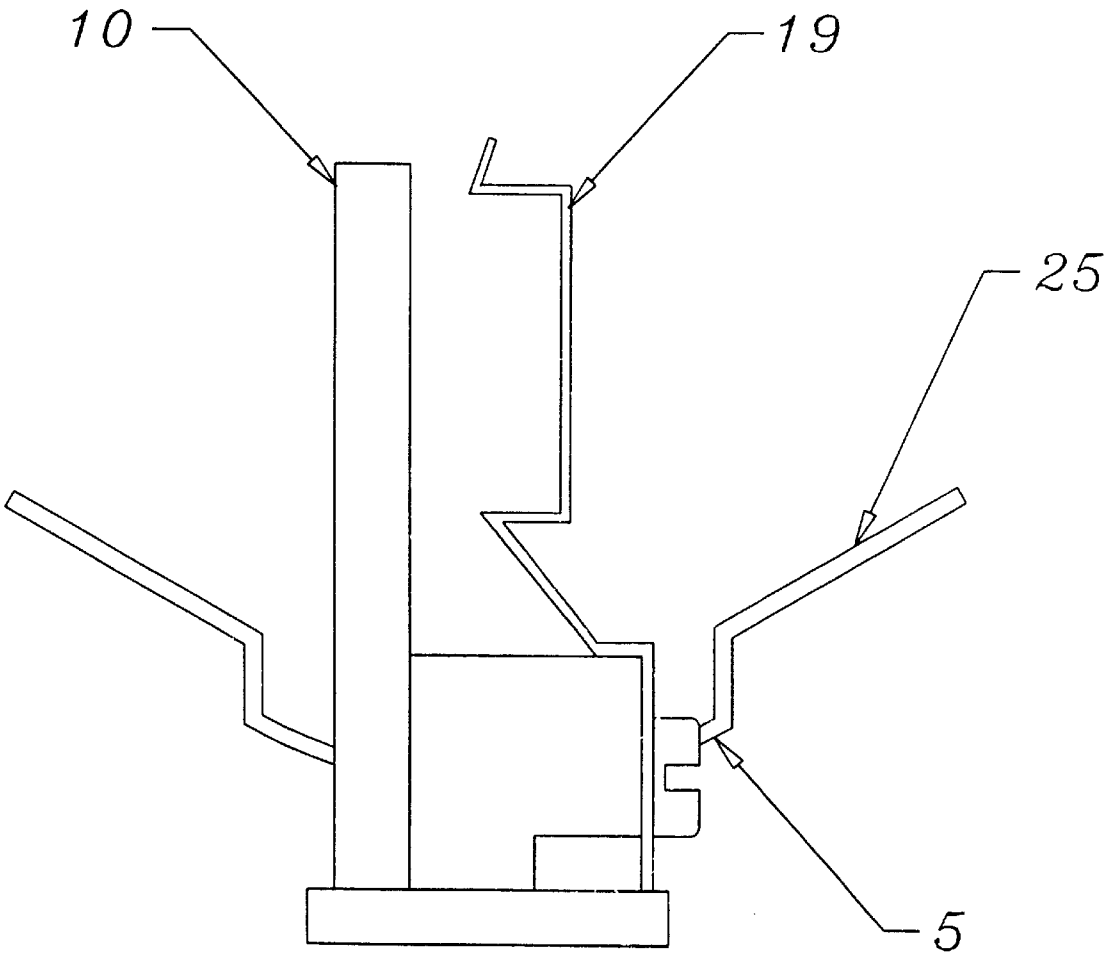
FIG. 21 is a cross-sectional view of the secondary reflector of FIG. 20 together with the lampholder.

FIGS. 20 and 21 show a third embodiment of the present invention similar to the embodiment of FIG. 2, but the installation of the primary and secondary reflectors is slightly different: the primary reflectors 4 are attached to the box 2 by means of the flanges 27 of the box 2 and the corresponding flanges 26 formed along the lateral edges of the primary reflectors 4. The secondary reflector 5 has outwardly directed lateral flanges 25 which are superimposed to outwardly directed lateral flanges 24 of the primary reflector 4. The superimposed flanges 24 and 25 are placed in close proximity to each other in order to prevent radiation loss on either sides of those reflectors. This type of arrangement allows to facilitate easy changing of lamps and maintenance of the heat reflector.

The main function of the secondary reflector 5 is to prevent all the radiation emitted from the IR lamp 9 through the gap 21 to reach the back plate 7 and the electrical circuits. It must be emphasised that heat radiation efficiency is one of the most significant considerations in designing heat radiators of any type. However, the higher irradiation requires higher lamp power (W) which produces the higher thermal conductivity to the other parts of the unit and, as a result, will raise temperature on the electrical connection and the back panel 7. Installing the secondary reflector 5 substantially reduces the back panel temperature, which is a very important advantage of such a design.

Tables 1 and 2 shows comparison data for units provided with the secondary reflectors (Table 1) and without those reflectors (Table 2). On Table 1, the tests were made on the following assemblies:

ZH2×2000 W (comprising two IR lamp each 1000 W)

ZH2×2000 WGC (with the protective ceramic glass in front of the reflectors);

ZH2×3000 W (comprising two lamps 1500 W each);

ZH2×3000 WCG (with protective ceramic glass).

As it is shown on those comparative Tables, the back panel temperature of the Unit comprising secondary reflector decreased down to 75° C. for the unit of ZH2/3000 W (with ceramic glass) if compared to 99° C. of the corresponding Philips 2×3000 W, and 53° C. for the unit of ZH2/2000 W (without ceramic glass) of Table 1 if compared with 79° C. of the corresponding 2×2000 W Philips unit of Table 2. As a conclusion, the back panel temperature of the heat radiator comprising secondary reflector decreases between 30 to 40%, which is a very important advantage of the present invention.

It has also been discovered that by adding the secondary reflector 5 on the unit, the irradiance ($W/m^2$) will significantly increase by 10 to 15% and the pinch temperature decreases by 20%, which is another very important feature of the present invention.

As it is shown on Table 2, the pinch temperature (column 6) reaches to the highest temperature of 290° C. for the unit Philips 2×3000 WCG. This temperature is very close to the critical temperature of pinch which is a highly undesirable factor as it will be explained below.

In an IR lamp, the pinch is one of the most critical elements. The pinch is the area of the glass tube which is sealed at both ends of the gas-filled glass tube. According to the safety standards, the pinch temperature for an infrared lamp should not exceed 350° C. On the unit ZH2×3000 WCG of the present invention with the protective ceramic glass, the maximum pinch temperature is 260° C., which is 30 degrees less than in a corresponding Philips unit. In the same unit without ceramic glass, the maximum pinch temperature is around 198° C., which is 25 degrees less than in a corresponding Philips unit. This difference in pinch temperatures is due to reflection of 10 to 15% of lost irradiation back by means of installing a secondary reflector of the present invention.

TABLE 1

| UNIT | $W/m^2$ 2m | $W/m^2$ 3m | $W/m^2$ 4m | Back panel T° C. | Pinch T° C. |
|---|---|---|---|---|---|
| ZH2/ 2000W | 310 | 135 | 80 | 53 | 146 |
| ZH2/GC 2000W | 268 | 124 | 71 | 80 | 191 |
| ZH2/ 3000W | 413 | 192 | 113 | 75 | 198 |
| ZH2/GC 3000W | 366 | 167 | 98 | 105 | 260 |

TABLE 2

| UNIT | $W/m^2$ 2m | $W/m^2$ 3m | $W/m^2$ 4m | Back panel T° C. | Pinch T° C. |
|---|---|---|---|---|---|
| Philips/2 2000W | 280 | 115 | 71 | 79 | 162 |
| Philips/2 2000W GC | 240 | 108 | 62 | 102 | 212 |
| Philips/2 3000W | 395 | 184 | 107 | 99 | 222 |
| Philips/2 3000W GC | 332 | 148 | 84 | 132 | 290 |

The columns 2, 3 and 4 of Tables 1 & 2 show the tests of irradiance $W/m^2$ done at distances of 2.3 and 4 meters. Comparative analysis clearly shows significant improvement in irradiation for units provided with a secondary reflector.

Preferably, ceramic glass used in the present invention is Neoceramic N-O type, with thickness of five millimeters made by Corning Glass Co. This type of glass is suitable for the present assembly in view of high transmittance of 90% in the range of 500 to 3000 nanometers (nm) with a good thermal dimensional stability. The ceramic glass can withstand the thermal shock of T=7000° C. However, as it is shown in table 1, the presence of the protective ceramic glass causes some reduction of irradiance emission and some increase in pinch and back panel temperatures.

Figure 22:
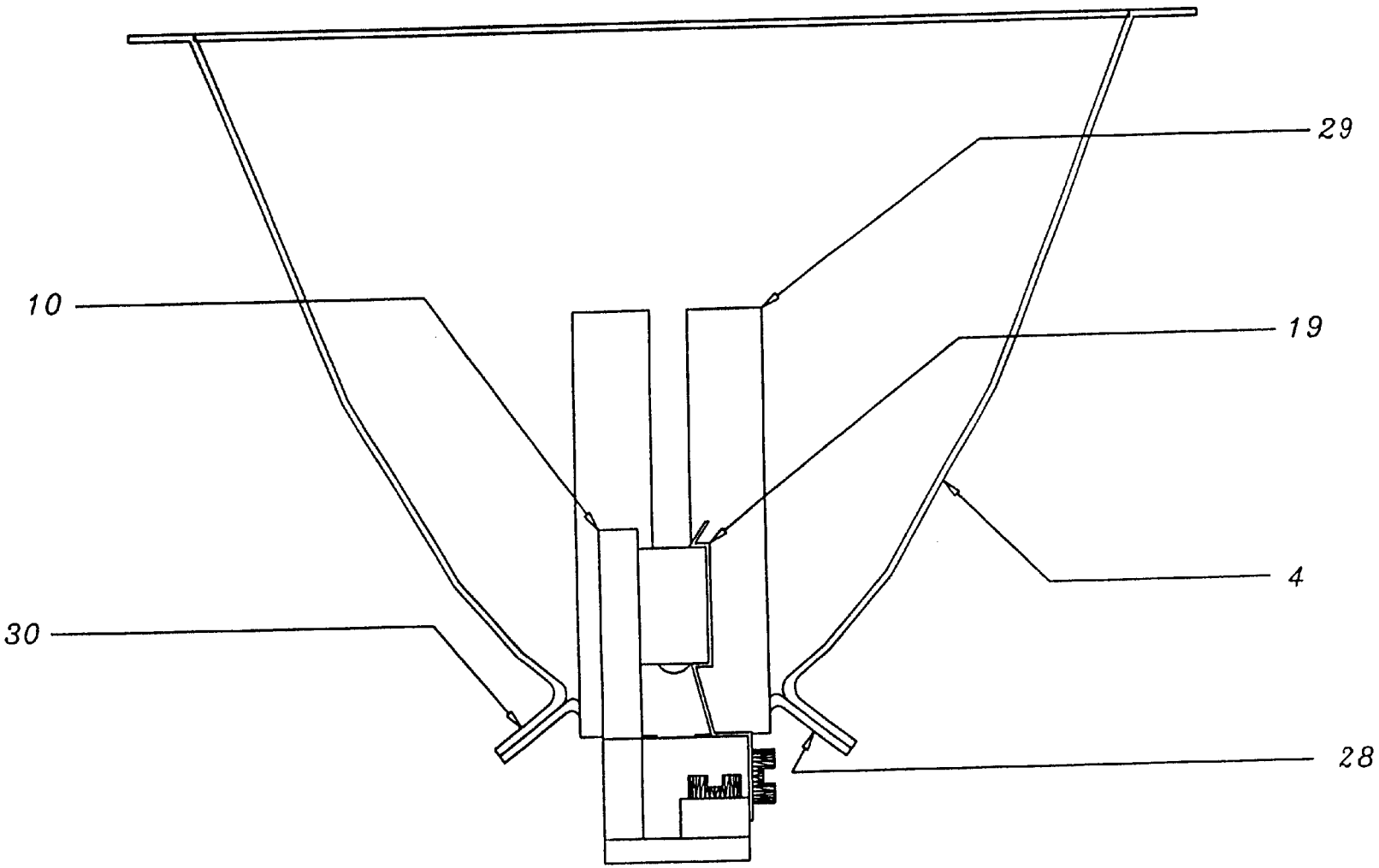
FIG. 22 is a cross-sectional view of the fourth embodiment of the present invention.
Figure 23:
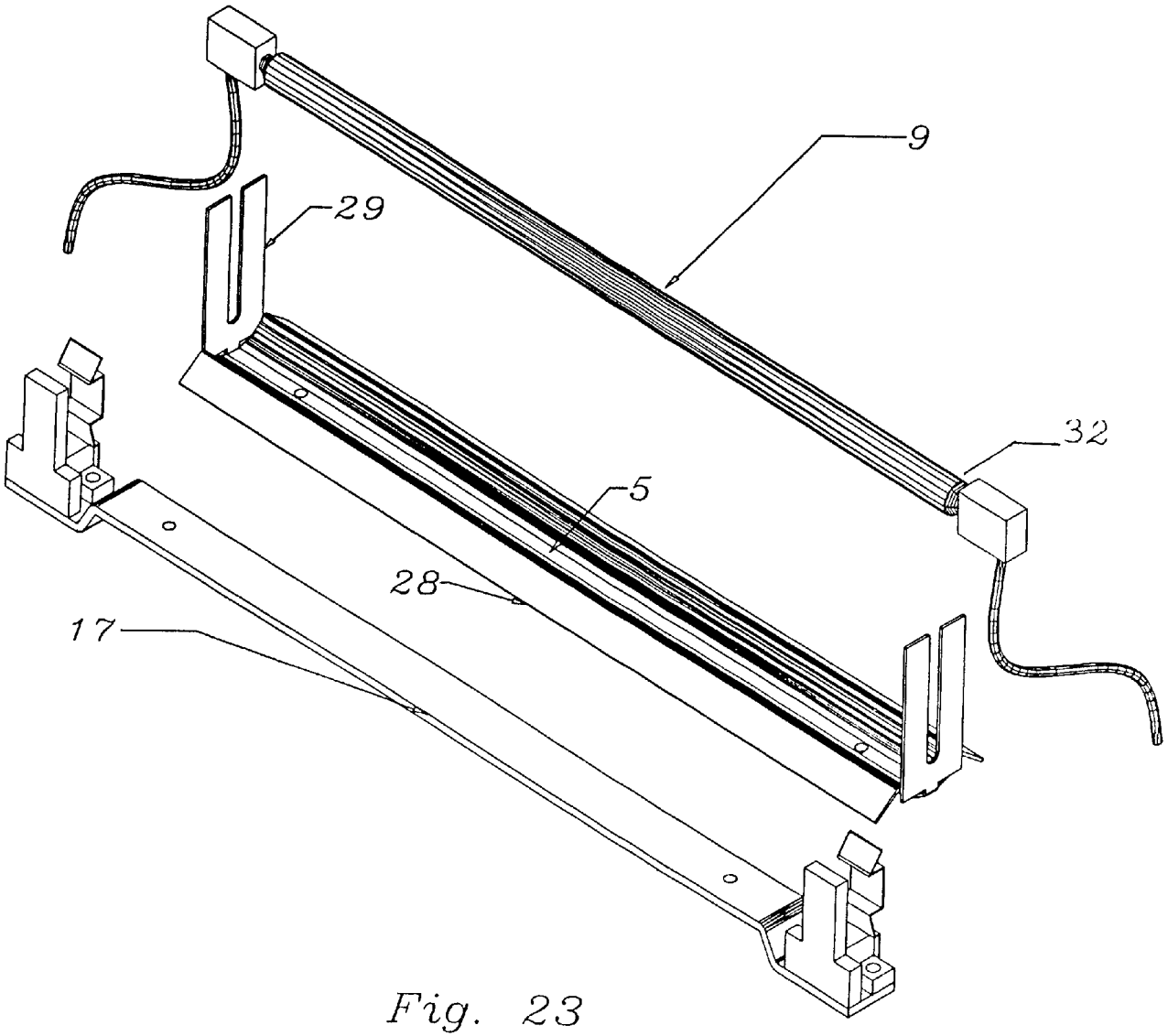
FIG. 23 is a partial perspective view of FIG. 22.
Figure 24:
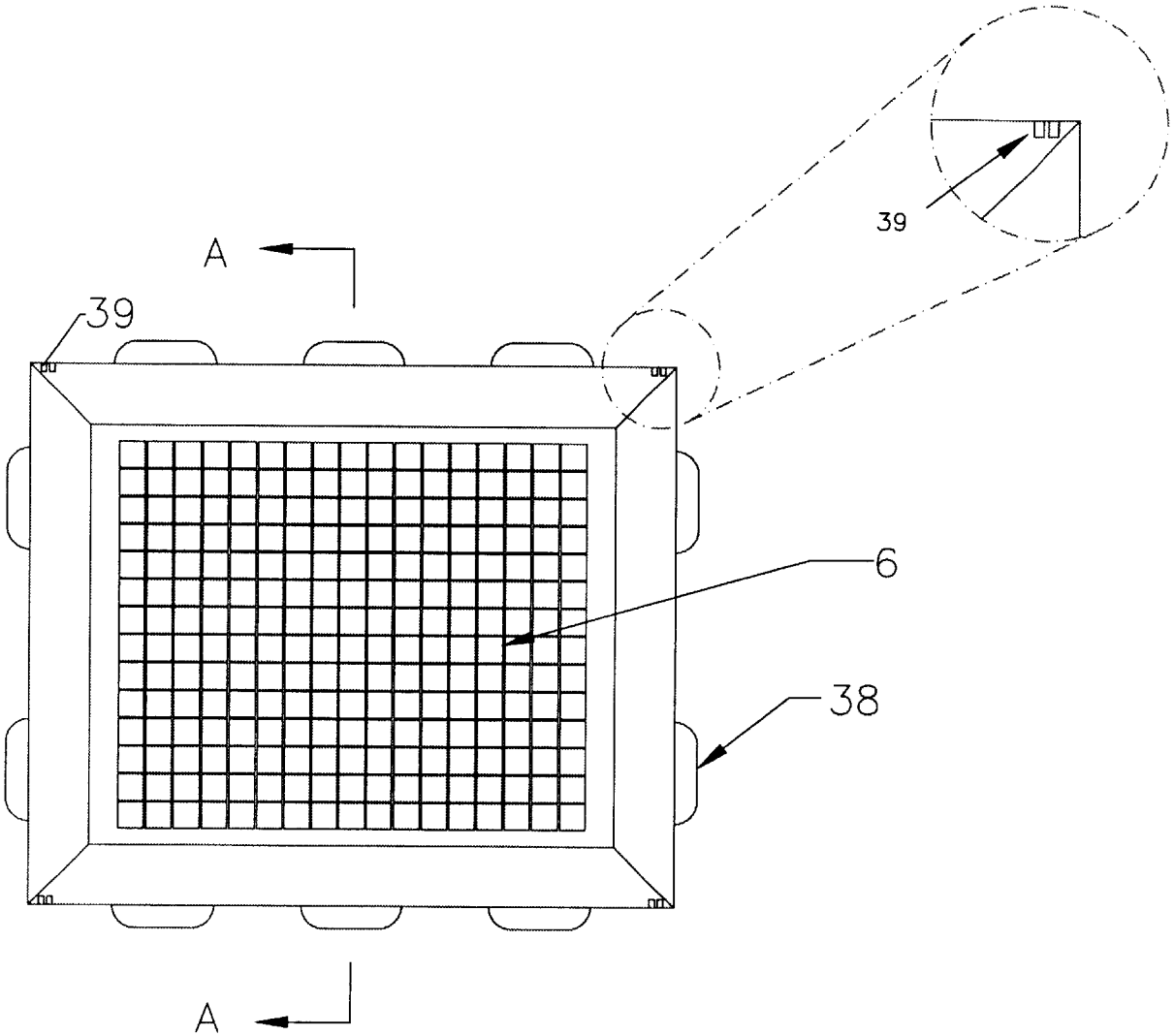
FIG. 24 is a front view of the fifth embodiment of the present invention.
Figure 25:
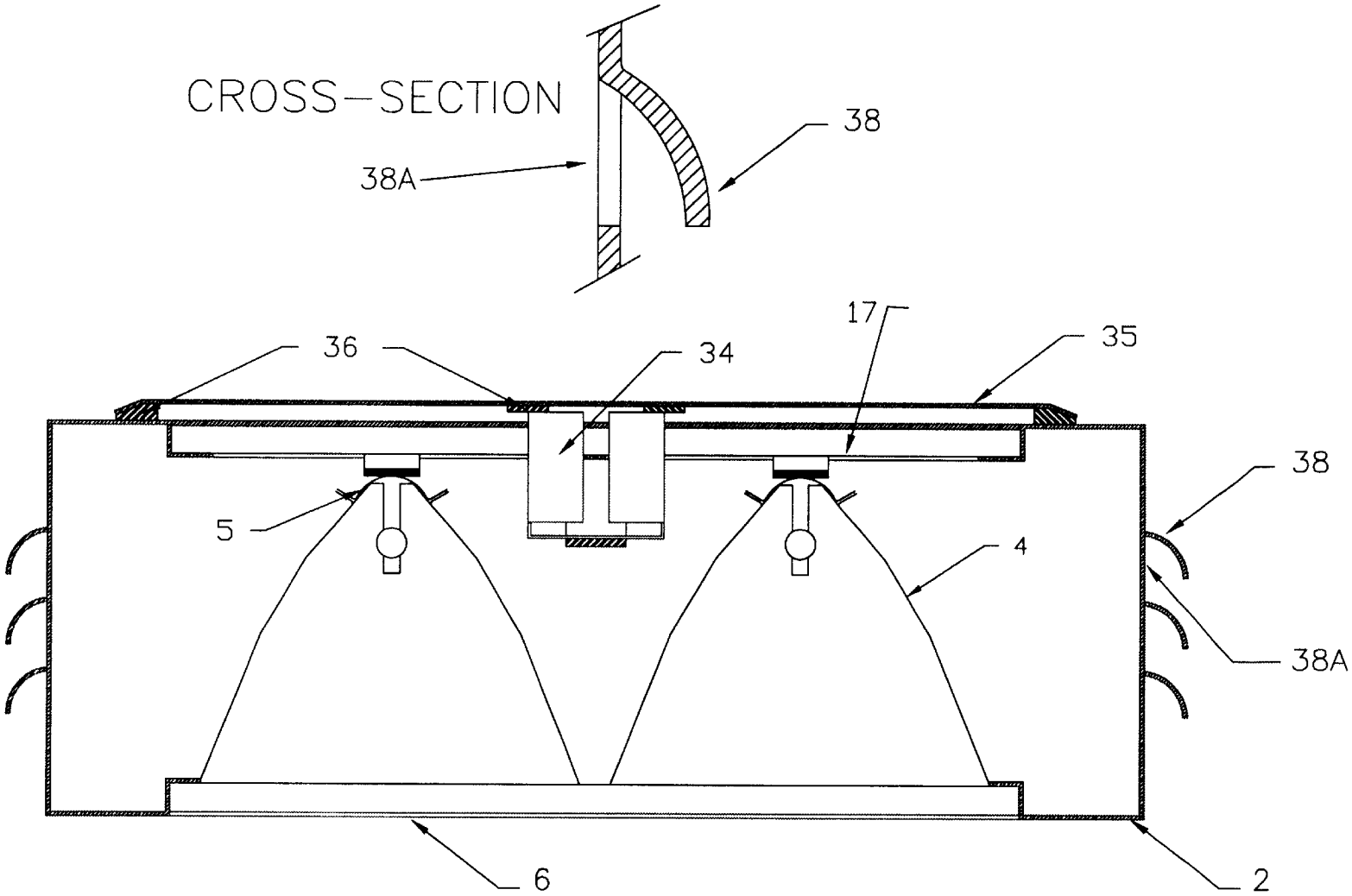
FIG. 25 is a cross-sectional view of FIG. 24 taken along the lines A—A.
Figure 26:
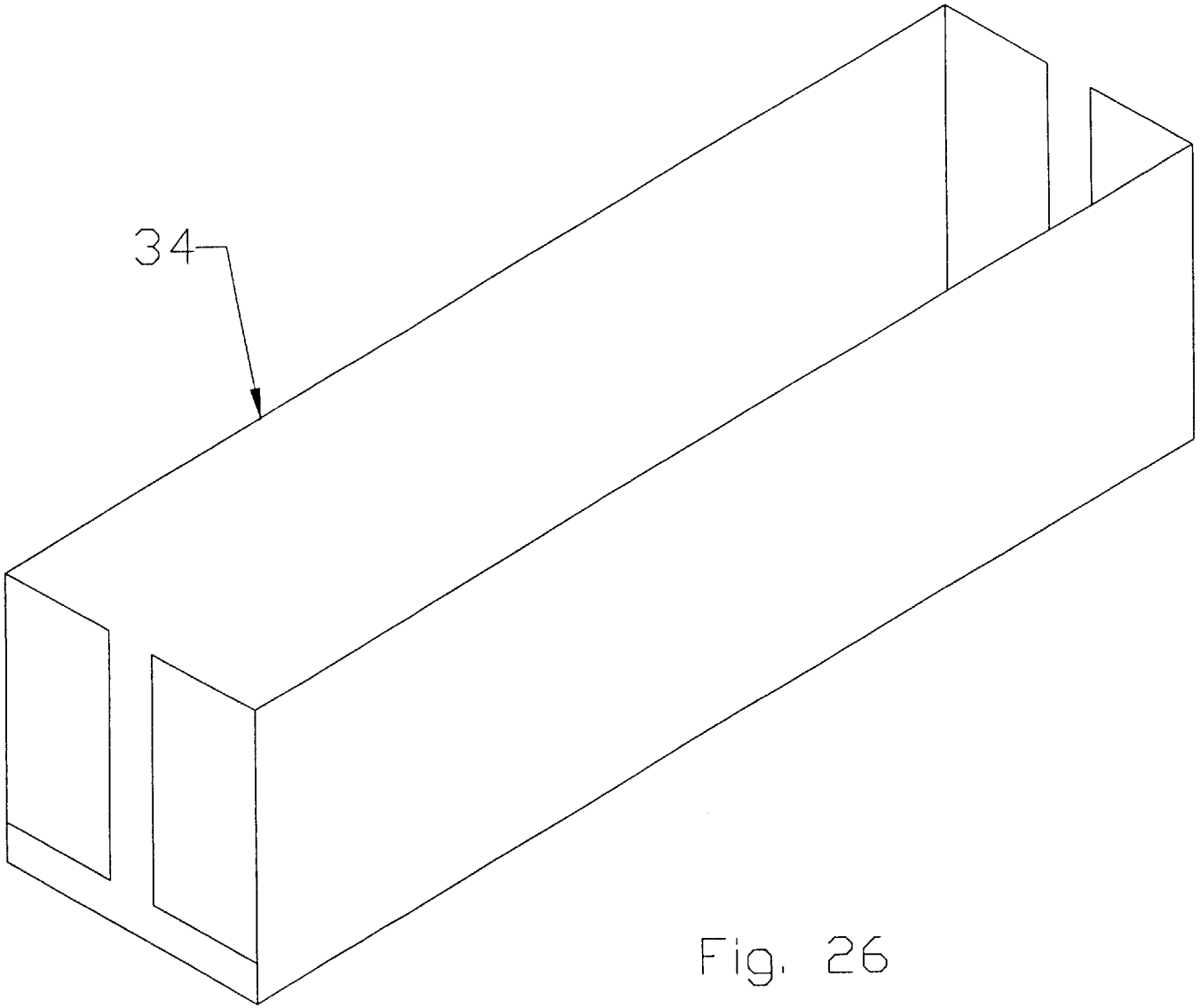
FIG. 26 is a perspective view of an internal junction box of FIG. 25.
Figure 27:
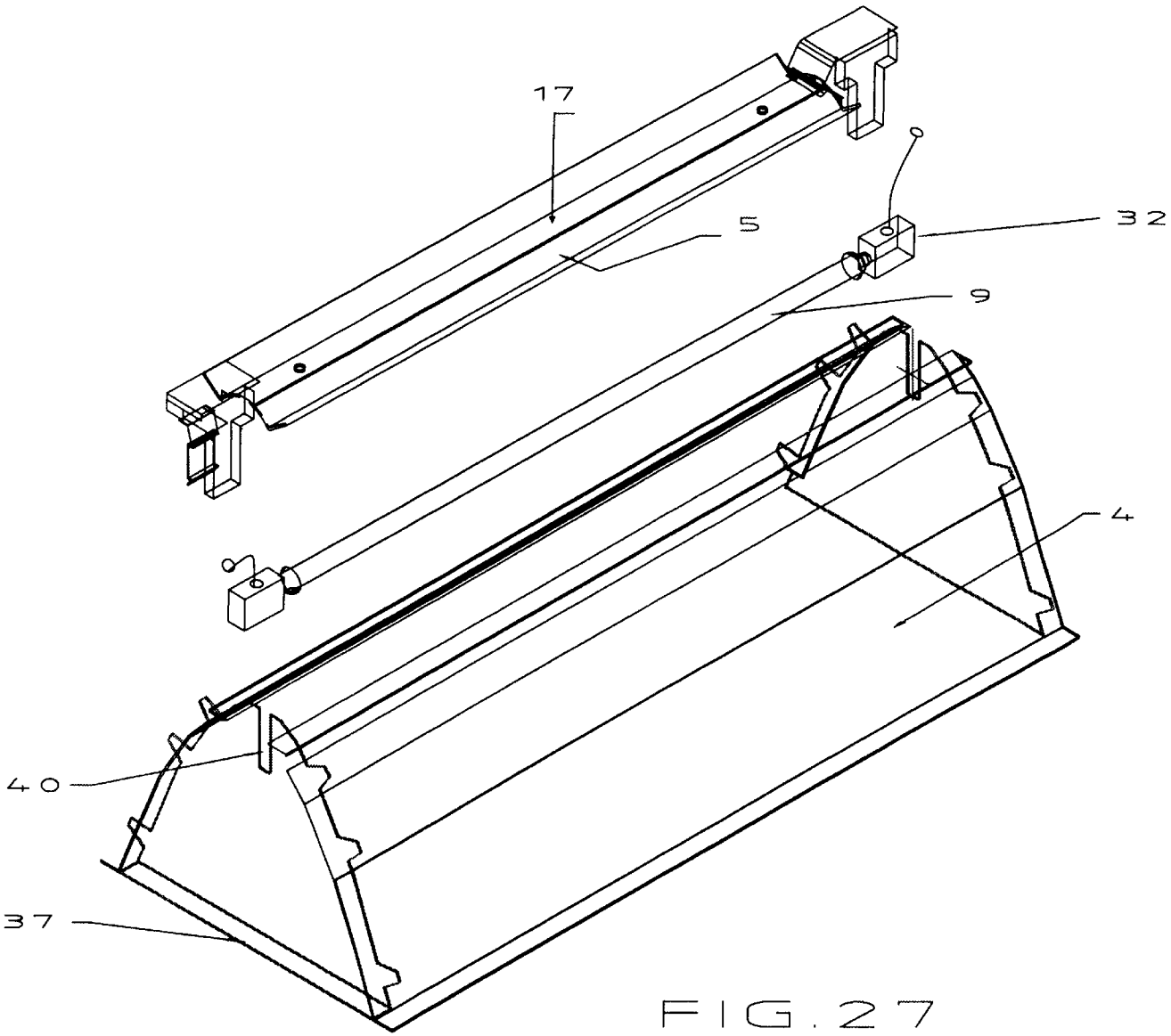
FIG. 27 is a perspective dis-assembled view of reflector assembly of FIG. 24.

FIGS. 22 and 23 shows a fourth embodiment of the present invention which is similar to the third embodiment shown on FIG. 20, except that flanges 30 of the first reflector 4 and the conesponding superimposed lateral edges 28 of the second reflector 5 are directed outwardly downwardly. Two vertically upstanding brackets 29 of generally U-shaped configuration are mounted near opposite ends of the second reflector 5 and are provided to additionally decrease the temperature of a pinch 32.

FIGS. 24–27 shows a fifth embodiment of the present invention adapted to withstand a foul weather and mostly used for outdoor purposes. For this reason side walls of the enclosure or box 2 (see FIG. 25) are provided with ventilating openings 38 having rain guards 38A adapted to prevent drops of rain to penetrate into the enclosure. Each corner of the box 2 (see FIG. 24) is provided with drainage holes 39 facilitating evacuation of water accidentally penetrating inside the box 2. Back cover 35 (see FIG. 25) is sealed against the moisture by means of silicon gaskets 36. This embodiment is also provided with an internal junction box 34 formed from aluminum sheet of substantially U-shape configuration (see FIG. 26). The purpose of this box is to accommodate and to connect all wiring of the assembly. The end walls 37 of primary reflector 5 are provided with U-shape slots 40 which are designed to eliminate the heat loss and to decrease the temperature of pinch 32 of the lamp 9. This embodiment of the present invention gives the versatility of using the assembly in indoor and outdoor conditions.

It must be emphasized that all embodiments of the present invention are adapted to withstand thermal expansion and to ventilate and evacuate the high power heat generated by IR lamp without damaging or destroying both reflectors which are made from very expensive gold anodized aluminum.

Thus, it can be seen that the objects of the present invention have been satisfied by the structure presented hereinabove. While in accordance with the Patent Statutes, only the best mode and preferred embodiments of the present invention has been presented and described in detail, it is to be understood that the invention is not limited thereto or thereby. Accordingly, for an appreciation of the true scope and breadth of the invention, references should be made to the following claims.

What is claimed is:

1. Heat radiator assembly comprising at least one heat radiator unit comprising in combination:

a base, a primary reflector mounted on said base, said primary reflector having an elongated body comprising side walls upstanding outwardly from said base and end walls, said primary reflector is adapted to accommodate a high power heating lamp, wherein said lamp is accommodated within said primary reflector by means of an elongated gap formed between lateral edges of the side walls of said primary reflector adjacent to said base, a secondary reflector mounted on said base, said secondary reflector having generally an elongated configuration, and including an inner surface and an outer surface, wherein said secondary reflector's inner surface is facing the elongated gap of said primary reflector and said outer surface is facing said base, and wherein said secondary reflector is adapted to reflect substantially most of lost radiation emitted from said lamp through said gap towards the base, thus facilitating prevention of overheating of said base and increasing efficiency of said heat radiator assembly;

wherein said primary and secondary reflectors are formed from a material adapted to withstand the high power heat generated by said lamp and to emit a yellow-gold glare-reduced colour;

said assembly is housed in an open enclosure or housing, wherein said housing is adapted to withstand thermal expansion and to ventilate and evacuate the high power heat generated by said lamp.

2. Heat radiator assembly according to claim 1, wherein the side walls of said primary reflector have a parabolic configuration in cross-section.

3. Heat radiator unit according to claim 1, wherein said secondary reflector has a concave configuration in cross-section.

4. Heat radiator assembly according to claim 1, wherein said assembly has a number of said heat radiator units parallel to each other.

5. Heat radiator assembly according to claim 1, wherein said primary and secondary reflectors are made of a tempered gold-anodized aluminum embossed with a pattern facilitating heat radiation efficiency and to strengthen structural integrity of the heat radiator unit.

6. Heat radiator assembly according to claim 1, wherein said lamp is mounted on said base by a lamp holder means.

7. Heat radiator assembly according to claim 1, wherein said primary reflector is connected to said secondary reflector.

8. Heat radiator unit according to claim 7, wherein the lateral edges of the side walls adjacent to said base of said primary reflector are provided with outwardly inverted flanges adapted to be connectably engaged with corresponding inwardly invented flanges formed along lateral edges of said secondary reflector.

9. Heat radiator assembly according to claim 1, wherein said lamp is an infrared lamp of tubular configuration.

10. Heat radiator assembly according to claim 2, wherein said side walls have a symmetrical parabolic configuration.

11. Heat radiator assembly according to claim 2, wherein said side walls have an asymmetrical parabolic configuration.

12. Heat radiator assembly comprising at least one heat radiator unit comprising in combination:

a base, a primary reflector mounted on said base, said primary reflector having an elongated body comprising side walls upstanding outwardly from said base and end walls, said primary reflector is adapted to accommodate a high power heating lamp, a secondary reflector mounted between said base and said primary reflector, said secondary reflector having generally an elongated configuration and including an inner surface and an outer surface, wherein said secondary reflector's inner surface is facing the lamp and said outer surface is facing said base, and wherein said secondary reflector is adapted to reflect substantially most of lost radiation emitted from said lamp towards the base, thus facilitating prevention of overheating of said base and increasing efficiency of said heat radiator assembly;

wherein said primary and secondary reflectors are formed from a material adapted to withstand the high power heat generated by said lamp and to provide a glare reduction;

said assembly is housed in an open enclosure or housing, wherein said housing is adapted to withstand thermal expansion and to ventilate and evacuate the high power heat generated by said lamp.

13. Heat radiator assembly according to claim 12, wherein the side walls of said primary reflector have a parabolic configuration in cross-section.

14. Heat radiator unit according to claim 12, wherein said secondary reflector has a concave configuration in cross-section.

15. Heat radiator assembly according to claim 12, wherein said assembly has a number of said heat radiator units parallel to each other.

16. Heat radiator assembly according to claim 12, wherein said primary and secondary reflectors are made of a tempered gold anodized aluminum embossed with a pattern facilitating heat radiation efficiency and to strengthen structural integrity of the heat radiator unit.

17. Heat radiator assembly according to claim 12, wherein said lamp is mounted on said base by a lamp holder means.

18. Heat radiator assembly according to claim 12, wherein said primary reflector is connected to said secondary reflector.

19. Heat radiator assembly according to claim 18, wherein said primary and said secondary reflectors forming a unitary one-piece configuration.

20. Heat radiator assembly according to claim 13, wherein said side walls have a symmetrical parabolic configuration.

21. Heat radiator assembly according to claim 13, wherein said side walls have an asymmetrical parabolic configuration.

22. Heat radiator unit according to claim 7, wherein the lateral edges of the side walls adjacent to said base of said primary reflector are provided with outwardly inverted flanges to be superimposed with corresponding outwardly inverted flanges formed along lateral edges of said secondary reflector.

23. Heat radiator unit according to claim 22, wherein said secondary reflector is provided with two vertically upstanding U-shaped lamp holders, said lamp holders being mounted near opposite ends of said second reflector and provided to additionally decrease the temperature of a pinch.

24. Heat radiator assembly according to claim 1, wherein said housing is provided with a number of ventilating openings formed at least on side walls of said housing and a protective grill mounted on a front wall of said housing.

25. Heat radiator assembly according to claim 24, wherein said housing is provided with rain guards placed over said ventilating openings and with sealing gaskets provided to seal a back wall of said housing, said housing is further provided with a number of drainage holes facilitating evacuation of water from said housing.

26. Heat radiator assembly according to claim 24, wherein said assembly is further provided with an internal junction box mounted over an electrical circuit system of said assembly, said junction box provided to accommodate and to connect wires of said electrical circuit system.

* * * * *